US007299859B2

(12) United States Patent
Bolle et al.

(10) Patent No.: US 7,299,859 B2
(45) Date of Patent: Nov. 27, 2007

(54) TEMPERATURE CONTROL OF THERMOOPTIC DEVICES

(75) Inventors: Cristian A. Bolle, Bridgewater, NJ (US); Christopher Richard Doerr, Middletown, NJ (US); Marc S. Hodes, New Providence, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 396 days.

(21) Appl. No.: 10/424,697

(22) Filed: Apr. 28, 2003

(65) Prior Publication Data

US 2004/0226695 A1 Nov. 18, 2004

(51) Int. Cl.
*F28D 15/00* (2006.01)
*H05K 7/20* (2006.01)

(52) U.S. Cl. ..... 165/104.21; 165/104.33; 361/700; 174/15.2

(58) Field of Classification Search ..... 165/104.21, 165/104.26, 104.33; 361/700, 702, 690; 174/15.2, 16.3; 372/35, 36, 34; 362/373; 359/820; 385/92, 88, 94
See application file for complete search history.

(56) References Cited

U.S. PATENT DOCUMENTS 4,099,556 A * 7/1978 Roberts, Jr. ..... 165/96
4,901,324 A * 2/1990 Martin ..... 372/36
5,181,214 A * 1/1993 Berger et al. ..... 372/34
5,253,260 A * 10/1993 Palombo ..... 372/34
6,041,850 A * 3/2000 Esser et al. ..... 165/104.33
6,252,726 B1 * 6/2001 Verdiell ..... 359/820
6,292,499 B1 * 9/2001 Pearson et al. ..... 372/36
6,517,221 B1 * 2/2003 Xie ..... 362/373
6,522,459 B1 * 2/2003 Pease et al. ..... 359/341.4
6,663,294 B2 * 12/2003 Crane et al. ..... 385/92
6,676,306 B2 * 1/2004 Ikeda et al. ..... 385/92

FOREIGN PATENT DOCUMENTS

JP 52098257 A * 8/1977

* cited by examiner

*Primary Examiner*—Tho Duong

(57) ABSTRACT

A low power or passive optical apparatus provides temperature control of dynamic thermooptic devices and temperature-sensitive optical devices formed on the same substrate. The optical apparatus includes a variable heat transfer device with a conductive heat transfer component (e.g., heat pipe) and a heat-conductive interface component (e.g., heat sink) to exchange thermal energy with an external environment. In one embodiment, the heat pipe has a variable resistance and the heat sink has a fixed thermal resistance. In a second embodiment, the heat pipe has a fixed resistance and the heat sink has a variable thermal resistance. In another embodiment both the heat pipe and heat sink have variable thermal resistance. In another embodiment, the optical apparatus further includes a thermoelectric cooler and the variable heat transfer device (e.g., variable heat pipe and/or heat sink) is used to reduce the temperature range over which said thermoelectric cooler operates, resulting in a lower power requirement for the thermoelectric cooler.

14 Claims, 2 Drawing Sheets

TEMPERATURE CONTROL OF THERMOOPTIC DEVICES

TECHNICAL FIELD OF THE INVENTION

This invention relates generally to temperature control of thermooptic devices and, more particularly, to a method and apparatus for low-power temperature control of thermooptic devices.

BACKGROUND OF THE INVENTION

Optical wavelength channel control devices, such as wavelength add-drop filters, can be made at low cost by integrating optical filters and power-dissipating active elements, such as thermooptic phase shifters, together on the same substrate. However, the thermooptic phase shifters dissipate power, whereas the optical filters need to be held at constant temperature. Since the power dissipation from the thermooptic phase shifters, the ambient temperature, and the characteristics of the ambient airflow over the device may vary with time, the temperature of the substrate tends to vary with time as well. However, the performance of the optical filters will be sacrificed if the substrate temperature cannot be maintained constant. FIG. 3 shows a prior art integrated optical device arrangement to hold constant substrate temperature, where the optical filters 101 and the thermooptic unit 102 are formed on a substrate 103 that is mounted to a thermoelectric cooler (TEC) 201 which is mounted on a heat sink 106. This prior art arrangement generally results in a thermal management solution consuming a very large amount of electrical power (on the order of that dissipated by the integrated optical device) which could otherwise be used to add more optical functionality to the device. This prior art solution also usually requires a stiff mechanical connection between the substrate 103 and the heat sink (106). This often results in unwanted strains and vibrations on the optical device due to environmental changes, often adversely affecting the optical response.

What is desired is a low-power technique to dissipate the heat from the substrate while holding the substrate at a constant temperature. Furthermore, it would be desirable for this technique to have only a flexible mechanical connection between the substrate and the heat sink.

SUMMARY OF THE INVENTION

We have recognized that the reason that a large amount of electrical power is required in the prior art arrangement is that the thermal resistance between the device and its ambient environment is constant. Specifically, in order to reduce the power required for a thermal management solution which holds the device at constant temperature, a variable heat sink 106 thermal resistance would be preferred. When the device is being heated in order to raise its temperature, a high thermal resistance heat sink 106 is desired in order to insulate the device. Conversely, when the device is being cooled in order to lower its temperature, a low thermal resistance heat sink 106 is desired in order to remove heat from the device.

In accordance with the present invention, the prior art thermal management problem is overcome by using a low power or passive apparatus that provides temperature control of dynamic thermooptic devices (ones that dissipate a time-varying amount and/or distribution of heat) and temperature-sensitive optical devices formed on the same substrate. The apparatus includes a passive, yet thermally conductive, heat transfer component (e.g., a heat pipe) connected to a heat-conductive interface component (e.g., a heat sink) to exchange thermal energy with an external environment. In one embodiment, the heat pipe has a variable thermal resistance (or conductance), and the connected heat sink has a fixed thermal transfer resistance to the ambient. In a second embodiment, the heat pipe has a fixed thermal resistance, and the heat sink has a variable thermal resistance to the environment. In a third embodiment the thermal resistance of both the heat pipe and the heat sink are variable. The heat pipe's resistance and/or heat sink's resistance is varied as a function of the thermooptic device power being dissipated, its distribution, the ambient temperature, and characteristics of the ambient airflow over the device in order to maintain the substrate at approximately a constant temperature. For example, if the substrate temperature is below the desired temperature for a given thermooptic power distribution, the thermal resistance of the heat pipe and/or heat sink are further reduced. As another example, when the external ambient temperature is below a certain value, the heat pipe and/or heat sink is "closed" dramatically reducing heat transfer to the ambient and resulting in the heat dissipated by the device being retained in order to keep the substrate warm.

More particularly in one embodiment, we disclose an optical apparatus comprising

- a temperature-sensitive optical component,
- a power dissipating optical component on the same substrate as the temperature-sensitive optical component,
- a heat-conductive interface component to exchange thermal energy with an external environment, and
- a variable resistance heat transfer component conducting heat between said substrate and said heat-conductive interface component, wherein the resistance of said heat transfer component is varied in order to maintain the temperature-sensitive optical component at a constant temperature.

In a more general embodiment, our optical apparatus comprises

- a temperature-sensitive optical component,
- a power dissipating optical component on the same substrate as the temperature-sensitive optical component, and
- a variable heat transfer device exchanging heat with said substrate at a variable rate in order to maintain the temperature-sensitive optical component at a constant temperature.

In another embodiment, a thermoelectric cooler is added between the substrate and the variable heat transfer component to more precisely regulate substrate temperature. Advantageously in such an embodiment, the variable heat transfer component reduces the temperature range over which said thermoelectric cooler operates, resulting in a lower power requirement for the thermoelectric cooler.

More particularly, this embodiment is directed to an optical component temperature regulating apparatus comprising

- a power dissipating optical component,
- a thermoelectric cooler located between the power dissipating optical component and a variable heat transfer device,
- said variable heat transfer device exchanging heat with said thermoelectric cooler at a variable rate in order to reduce the temperature range over which said thermoelectric cooler operates and, hence, its power consumption.

BRIEF DESCRIPTION OF THE DRAWINGS

The present invention will be more fully appreciated by consideration of the following Detailed Description, which should be read in light of the accompanying drawings in which.

In the following description, identical element designations in different figures represent identical elements. Additionally in the element designations, the first digit refers to the figure in which that element is first located (e.g., 101 is first located in FIG. 1).

DETAILED DESCRIPTION

Figure 1:
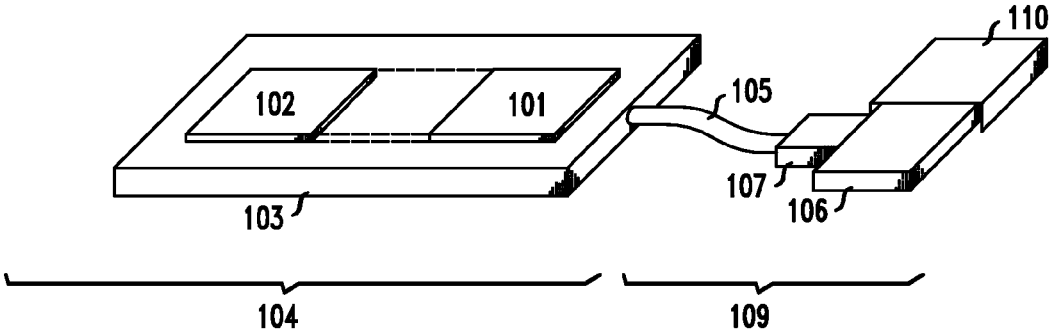
FIG. 1 illustrates a preferred embodiment of our arrangement for providing a low-power temperature control of thermooptic devices.

With reference to FIG. 1 there is shown a block diagram of an optical apparatus utilizing our thermal management arrangement. The apparatus includes an optical unit 104, illustratively, including a temperature-sensitive optical unit 101 and a power-dissipating active optical unit 102, such as a thermooptic unit, both formed or mounted on a substrate 103. A thermooptic unit is an optical device that uses very localized temperature changes to perform dynamic optical functions. The thermooptic unit dissipates power, which eventually must be rejected to the external environment. Note that while the temperature-sensitive optical unit 101 and thermooptic unit 102 are shown as separate devices or chips they could also be formed together on the same device or chip (shown in dotted lines). For example, 101 and 102 could be silica-waveguide-based devices on a silicon substrate, and 103 could be a metal heat spreader. The optical apparatus 104 is thermally insulated or isolated from the external environment, except for a passive heat transfer component 105 for conducting heat between the said substrate 103 and a heat-conductive interface component 106, wherein the resistance (or conductance) of said heat transfer component 105 and/or said heat-conductive interface component 106 is varied in order to maintain the temperature-sensitive optical unit 101 to within a specified temperature range. The heat-conductive interface component 106 couples heat to an external environment. When the optical apparatus is utilized within a building, the external environment would be a temperature-controlled environment, 20 to 30 degrees centigrade. When the optical apparatus is utilized in an "outside plant," the external environment is not temperature-controlled and temperatures can typically range from −40 to +40 degrees centigrade (° C.).

The temperature-sensitive optical unit 101 may include one or more optical devices or components such as a, filter, waveguide grating router, multiplexer/demultiplexer, laser, amplifier, attenuator, etc. The power-dissipating active unit 102 may contain one or more thermooptic devices or components such as a dynamic optical switch, variable attenuator, tunable filter, dynamic amplifier, thermooptic phase shifter, etc. These components of the temperature-sensitive optical unit 101 and power-dissipating active unit 102 may be formed in a well-known manner using silica, silicon, semiconductors, polymer, etc.

The passive variable resistance heat transfer component 105, illustratively, may be a heat pipe. There are many ways to make a variable resistance heat pipe. For instance, the heat pipe 105 can use a thermostatically controlled valve 107 to control fluid flow through the pipe, thereby changing the thermal resistance of the heat pipe as temperature changes. This valve could either be controlled internally or by an external system that measures the temperature of the substrate. If a thermostatically controlled valve 107 is used, it can be located anywhere along the heat pipe 105 from just outside the thermally insulated portion 104 of the optical apparatus to just before the heat-conductive interface component 106 (as shown). The heat-conductive interface component 106 may be a heat sink to an external environment or other thermal interface to an external environment. The passive variable resistance heat transfer component 105 and the heat-conductive interface component 106 together are referred to herein as a passive variable heat transfer device or unit 109 for exchanging heat from the substrate 103 to the external environment at a variable rate in order to maintain the substrate 103 and, therefore, the temperature-sensitive optical component 101 within a narrower temperature range.

In accordance with our invention, the variable resistance heat transfer component 105 has its thermal resistance controlled by the temperature of the heat-conductive interface component 106 (external environment). The thermal resistance of heat transfer component 105 varies in a manner that is related to the desired temperature of the substrate 103, heat dissipated by the substrate 103, and the external environment, i.e., its temperature and the character of the air flow (or lack thereof) over interface component 106. When the substrate 103 temperature is above a predetermined value, the variable resistance heat transfer component 105 (e.g., heat pipe) is "open," conducting away as much of the substrate 103 heat as possible to the external environment. When the substrate 103 temperature is below a predetermined value, the variable resistance heat transfer component 105 is "closed," and the heat is retained to keep the substrate 103 warm. In one illustrative embodiment, the temperature of an insulated substrate 103 is assumed to be about 75° C., which is higher than the hottest possible external temperature, 65° C., for example. Note that the maximum heat transfer rate of the heat pipe 105 is greater than the heat generation rate of the power-dissipating active unit 102. When the external temperature is at its maximum, the heat pipe 105 is likely near a maximum conductance or heat transfer rate and the temperature of the substrate 103 would be maintained at some higher predetermined temperature. Thus, the temperature-sensitive optical component 101 can be designed for optimization at about 65° C. or above, for example, and optimum operation will be maintained irrespective of the variations in the external temperature.

Advantageously, since the variable resistance heat transfer component 105 (or heat pipe) can be made to utilize very little electrical power or to be completely passive, our optical apparatus thermal management arrangement is a power efficient technique for the temperature control of thermooptic devices.

Furthermore, advantageously, since the heat transfer component 105 can be a heat pipe with a relatively narrow diameter, be made of a relatively soft or elastic material, such as copper, or contain bellows, the mechanical linkage between the substrate 103 and outside world can be greatly reduced over prior art techniques, essentially eliminating outside world changes from causing strains and/or vibrations in the optical devices.

Note that in the above example, if the optical apparatus of FIG. 1 is utilized within a building, the external environment would be a temperature-controlled environment, ~20 to 30°

C., for example, and, hence, the temperature of the substrate 103 can be maintained to an even more constant temperature.

In another embodiment, the variable heat transfer unit 109 (heat transfer component 105 [heat pipe] and the heat-conductive interface component 106 [heat sink]) can be implemented using a fixed resistance heat transfer component 105 and a variable resistance heat-conductive interface component 106. Such a variable resistance heat-conductive interface component 106 can be implemented as a thermostatically controlled heat sink. The thermostatically controlled heat sink could be a passive or low power active unit. In this embodiment, it is the thermal resistance of the heat sink 106 that is varied (rather than the heat pipe 105) in order to maintain the substrate 103 and temperature-sensitive optical component 101 at a constant temperature. The thermal resistance of the heat sink 106 could, for example, be altered by using a movable shroud 110 whose position is changed to cover/uncover a portion of the cooling fins of the heat sink 106. The position of the movable shroud could be changed in a passive (e.g., using a bi-metal strip) or active (e.g., using a low-power stepper motor) manner. This embodiment of a passive/active variable heat transfer unit 109 using a fixed heat pipe 105 and a variable heat sink 106 would then operate in the same manner as the previously-described embodiment of a passive/active variable heat transfer unit 109 having a variable heat pipe 105 and fixed heat sink 106. Another embodiment may use both a variable resistance heat transfer component 105 and a variable resistance heat sink (106).

Figure 2:
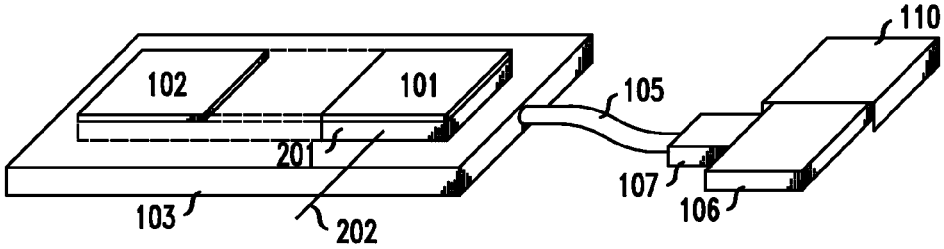
FIG. 2 shows another embodiment which includes a thermoelectric cooler (TEC).
Figure 3:
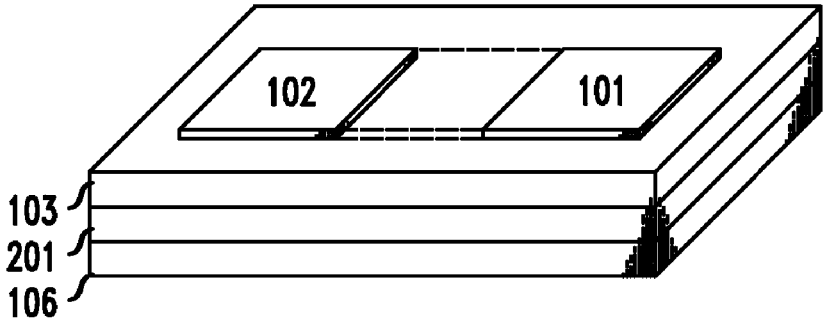
FIG. 3 (PRIOR ART)
FIG. 3 shows a prior art technique for temperature control of thermooptic devices.

Shown in FIG. 2 is another embodiment of an optical apparatus utilizing our thermal management arrangement, which further includes a thermoelectric cooler TEC 201 located between the temperature-sensitive optical unit 101 and substrate 103. The TEC 201 is used to further control or "fine tune" the temperature of the power-dissipating active unit 102 and temperature-sensitive optical unit 101. The TEC 201 is actively controlled using control lead 202 to control the application of external power to regulate its temperature. The TEC 201 is used to further regulate (or fine tune) the temperature of the temperature-sensitive optical unit 101 relative to the temperature of the substrate 103. The temperature can be fine tuned because TEC 201 acts as a refrigerator or heat pump. Because the TEC 201 is used only to "fine tune" the temperature of the temperature-sensitive optical unit 101, the total power consumed by the TEC 201 in FIG. 2 is significantly less than that of TEC 201 in the prior art FIG. 3.

Thus in accordance with this aspect of our invention, the variable heat transfer device 109 (e.g., variable heat pipe and/or heat sink) is used to reduce the temperature range over which said TEC 201 operates, resulting in a lower power requirement for TEC 201. Such an arrangement produces a low-power optical component temperature regulating apparatus because the variable heat transfer device 109 adjusts its thermal resistance thereby compensating for changes in external ambient temperature. The result is that the variable heat transfer device 109 reduces the temperature range that its presents to the TEC 201 to just a fraction of the external ambient temperature range.

In FIG. 2, note that while the temperature-sensitive optical unit 101 and thermooptic unit 102 are shown as separate devices or chips they could also be formed together on the same device or chip (shown in dotted lines). In such an arrangement, TEC 201 would then be located under that common device or chip (as also shown in dotted lines).

We claim:

1. A temperature regulated optical apparatus comprising a temperature-sensitive optical component, a power dissipating optical component on the same substrate as the temperature-sensitive optical component, said substrate thermally insulated from an external environment, except for a variable resistance heat transfer component for conducting heat away from said substrate, a heat-conductive interface component to exchange thermal energy with the external environment, and said variable resistance heat transfer component including a flexible curved heat pipe having a length to diameter aspect ratio that is much greater than one so that the substrate is physically well-separated from said heat-conductive interface component so as to provide an elastic mechanical linkage between said substrate and said heat-conductive interface component to minimize strain or vibrations to the optical components on said substrate, said heat transfer component for maintaining the temperature of said substrate so that when the substrate temperature is above a predetermined value the conductance of said heat transfer component is increased to increase the transfer of heat between said substrate and said heat-conductive interface component and when the substrate temperature is below the predetermined value the conductance of said heat transfer component is decreased to retain the heat in said substrate with low heat leakage to the external environment, wherein in this manner said heat transfer component maintains the temperature-sensitive optical component at a constant temperature.

2. The optical apparatus of claim 1 wherein the variable conductance of said heat transfer component is achieved using said heat pipe with a controllable valve.

3. The optical apparatus of claim 1 wherein the heat-conductive interface component is a heat sink.

4. The optical apparatus of claim 1 further comprising a thermoelectric cooler inserted between the temperature-sensitive optical component and the variable heat transfer component.

5. The optical apparatus of claim 1 wherein the resistance of said heat transfer component varies in a manner that is proportional to the temperature offset of the substrate from a desired value.

6. The optical apparatus of claim 1 wherein the resistance of said heat transfer component varies as a function of both the temperature of the external environment and the temperature of said substrate.

7. The optical apparatus of claim 1 wherein the variable heat transfer component is a passive component.

8. A temperature regulated optical apparatus comprising a temperature-sensitive optical component, a power dissipating optical component on the same substrate as the temperature-sensitive optical component, said substrate thermally insulated from an external environment, except for a variable resistance heat transfer component for conducting heat away from said substrate, and said variable resistance heat transfer component including a flexible curved heat pipe having a length to diameter aspect ratio that is much greater than one so that the substrate is physically well-separated from the external environment so as to provide an elastic mechanical linkage between said substrate and the external environment to minimize strain or vibrations to the optical components on said substrate, said heat transfer component for maintaining the temperature of said substrate so that when the substrate temperature is above a predetermined value the conductance of said heat transfer component is increased to increase the transfer of heat from said substrate to the external environment and when the substrate temperature is below the predetermined value the conductance of said heat transfer component is decreased to retain the heat in said substrate with low heat leakage to the external environment, wherein in this manner said heat transfer component maintains the temperature-sensitive optical component at a constant temperature.

9. The optical apparatus of claim 8, where the variable heat transfer component further includes a variable heat-conductive interface component to exchange thermal energy with the external environment, wherein the curved heat pipe conducts heat between said substrate and the variable heat-conductive interface component, and wherein the thermal resistance of the variable heat-conductive interface component is varied in order to maintain the temperature-sensitive optical component at a constant temperature.

10. The optical apparatus of claim 8 further comprising a thermoelectric cooler located between the temperature-sensitive optical component and the variable heat transfer component.

11. An optical apparatus comprising a temperature-sensitive optical component, a power dissipating optical device on the same substrate as the temperature-sensitive optical component, and a variable heat transfer device exchanging heat with said substrate at a variable rate in order to maintain the temperature-sensitive optical component at a constant temperature, where the variable heat transfer device comprises a variable heat-conductive interface component to exchange thermal energy with an external environment, a conductance heat transfer component conducting heat between said substrate and the heat-conductive interface component, wherein the thermal resistance of the variable heat-conductive interface component is varied in order to maintain the temperature-sensitive optical component at a constant temperature, and wherein the variable heat-conductive interface component is a heat sink having a movable shroud whose position is varied in order to maintain the temperature-sensitive optical component at a constant temperature.

12. The optical apparatus of claim 11 wherein the movable shroud is controlled by a low-power stepper motor.

13. The optical apparatus of claim 9 wherein the variable heat transfer device is a passive device.

14. An optical component temperature regulating apparatus comprising power dissipating optical component, a thermoelectric cooler located between the power dissipating optical component and a variable heat transfer device, said variable heat transfer device exchanging heat with said thermoelectric cooler at a variable rate in order to reduce the temperature range over which said thermoelectric cooler operates, where said variable heat transfer device comprises a variable heat-conductive interface component to exchange thermal energy with an external environment, a conductance heat transfer component conducting heat between said power dissipating optical component and the heat-conductive interface component, wherein the variable heat-conductive interface component is varied in order to control the temperature of said power dissipating optical component at a constant temperature, and wherein the variable heat-conductive interface component is a heat sink having a movable shroud whose position is varied in order to maintain the temperature-sensitive optical component at a constant temperature.

* * * * *